US008253659B2

(12) United States Patent
Maekawa et al.

(10) Patent No.: US 8,253,659 B2
(45) Date of Patent: Aug. 28, 2012

(54) DISPLAY DEVICE AND PIXEL CIRCUIT

(75) Inventors: Yuichi Maekawa, Kanagawa (JP); Koichi Miwa, Yokohama (JP)

(73) Assignee: Global OLED Technology, LLC., Wilmington, DE (US)

( * ) Notice: Subject to any disclaimer, the term of this patent is extended or adjusted under 35 U.S.C. 154(b) by 408 days.

(21) Appl. No.: 12/615,497

(22) Filed: Nov. 10, 2009

(65) Prior Publication Data

US 2010/0134388 A1 Jun. 3, 2010

(30) Foreign Application Priority Data

Nov. 28, 2008 (JP) ..... 2008-305141

(51) Int. Cl.
*G09G 3/30* (2006.01)

(52) U.S. Cl. ..... 345/76; 345/77

(58) Field of Classification Search ..... 345/76, 345/77

See application file for complete search history.

(56) References Cited

U.S. PATENT DOCUMENTS 7,057,588 B2 6/2006 Asano et al.
2005/0206590 A1 9/2005 Sasaki et al.
2006/0208977 A1 * 9/2006 Kimura ..... 345/76
2008/0198104 A1 * 8/2008 Yamashita et al. ..... 345/77

FOREIGN PATENT DOCUMENTS

JP 2006-259174 9/2006

* cited by examiner

*Primary Examiner* — Alexander Eisen
*Assistant Examiner* — Amit Chatly
(74) *Attorney, Agent, or Firm* — McKenna, Long and Aldridge, LLP.

(57) ABSTRACT

To efficiently compensate a threshold value of a driving transistor. In a state where a first switching transistor is non-conductive and a second switching transistor in conductive, a sampling transistor is made conductive and a reference voltage is supplied from a signal line to write a threshold voltage of a driving transistor to a first capacitance. After that, in a state where first and second switching transistors and are non-conductive, the sampling transistor is made conductive and a signal voltage from the signal line is written to the first capacitance. Further, after that the sampling transistor is put into a non-conductive state, and the first and second switching transistors are put in a conductive state, to drive the driving transistor and supply current to a light emitting element.

2 Claims, 13 Drawing Sheets

DISPLAY DEVICE AND PIXEL CIRCUIT

CROSS-REFERENCE TO RELATED APPLICATION

This application claims priority of Japanese Patent Application No. 2008-305141 filed Nov. 28, 2008 which is incorporated herein by reference in its entirety.

FIELD OF THE INVENTION

The present invention relates to an active matrix type display device for driving light emitting elements using a driving transistor for every pixel, and to a pixel circuit for the display device.

BACKGROUND OF THE INVENTION

Conventionally, as a low-profile display, liquid crystal displays using liquid crystal have become widespread. On the other hand, an organic electroluminescent element (OLED) is a self-emissive element, and is capable of high contrast display, has fast response speed, and also has the advantage that since a backlight is not required reduced power consumption can be expected. For this reason OLED display are becoming widespread.

Here, among these types of display, the mainstream type is an active matrix type display having a driving transistor provided for each line, for controlling pixel display using the driving transistors. In the case of liquid crystals, it is possible for a driving transistor to control an applied voltage to the liquid crystal, but in the case of OLED, current flowing in the OLED must be controlled with the driving transistor.

Accordingly, in an OLED display, there are variations in output current between driving transistors, and if they are used as they are it is detrimental to display quality. On the other hand, the driving transistor of each line is formed using a silicon layer formed on a comparatively large glass substrate, which shows that it is difficult to make variations in the characteristics of the driving transistor, and in particular variations in the threshold voltage at which current starts to flow to the diving transistor, small. Therefore, in order to achieve improved display quality, there have been various proposals to correct the threshold voltage of the transistor used for driving and suppress variations in drive current (See U.S. Pat. No. 7,057,588, U.S. Patent Application Publication No. 2005-0206540 and JP 2006-259714).

However, in the above described related art U.S. Pat. No. 7,057,588, U.S. Patent Application Publication No. 2005-0206540 and JP 2006-259714, there are the following problems.

For example, with U.S. Patent Application Publication No. 2005-0206540, at the time of the signal voltage write process, the sampling transistor is made conductive to sample the signal voltage. At this time, the driving transistor is placed in an ON state because the threshold voltage has been exceeded. Accordingly, when writing the signal voltage it is easy for the threshold voltage held in a capacitance to drain away. In particular, as the sampling time for the signal voltage becomes longer and the signal voltage becomes larger, this reduction becomes more prominent. In order to prevent the drawback of this type of threshold voltage draining, a large capacitance is required, which increases the surface area of a constricted element, and it is also easy for the incidence of defects to rise.

With U.S. Pat. No. 7,057,588, it is necessary to provide three or four scanning lines for threshold voltage correction and for signal voltage sampling. Accordingly the structure is complicated and it is easy for incidence of defects to rise. Also, with JP 2006-259714, since drive current is affected by voltage variation of the OLED, there is a problem that degree of freedom for stable operation is narrowed.

SUMMARY OF THE INVENTION

The present invention is directed to an active matrix type display device, having pixels arranged in a matrix, each pixel including a light emitting element for emitting light as a result of current flow, a sampling transistor, switched between being conductive and non-conductive by a first scanning line, for sampling a signal voltage that determines a light emitting level of the light emitting element from the first scanning line, a driving transistor for supplying a current corresponding to the voltage sampled by the sampling transistor to the light emitting element, a first switching transistor, switched between being conductive and non-conductive by a second scanning line, for controlling current from a power supply line to the driving transistor, a second switching transistor, switched between being conductive and non-conductive by a third scanning line, for controlling current transmitted from the driving transistor to the light emitting element, a first capacitance for holding a sampled signal voltage and a threshold voltage of the driving transistor across a gate electrode and a source electrode of the driving transistor, during a light emission period of the light emitting element, and a second capacitance arranged between the source terminal of the driving transistor and the power supply line, with the display device including a signal line drive circuit for controlling signal lines arranged in a column direction, a first scanning line drive circuit for controlling the first scanning lines, a second scanning line driving circuit for controlling the second scanning lines arranged in a row direction, and a third scanning line driving circuit for controlling the third scanning lines arranged in the row direction, and wherein the signal lines are arranged in the column direction, and the first to third scanning lines are arranged in the row direction.

It is also possible for the second scanning lines to be arranged one for every two lines, and connected to pixels of both upper and lower sides.

It is also possible for the third scanning line to be arranged one for every two lines, and connected to pixels of both upper and lower sides.

It is also possible to have a structure where in a period when a reference voltage is being supplied from the signal line, the sampling transistor is conductive, and in a period when the first switching transistor is non-conductive, the threshold voltage of the drive transistor is held on the first capacitance.

It is also possible to have a structure where in a period when the sampling transistor is conductive, and in a period when the first switching transistor is non-conductive, a signal voltage from the signal line is held on the first capacitance.

It is also possible for the drive frequency of the second scanning line drive circuit to be ½ the drive frequency of the first scanning line drive circuit.

It is also possible for the drive frequency of the third scanning line drive circuit to be ½ the drive frequency of the first scanning line drive circuit.

Also, a pixel circuit includes a light emitting element for emitting light as a result of current flow, a sampling transistor, switched between being conductive and non-conductive by a first scanning line, for sampling a signal voltage that determines a light emitting level of the light emitting element from the first scanning line, a driving transistor for supplying a current corresponding to the voltage sampled by the sampling transistor to the light emitting element, a first switching transistor, switched between being conductive and non-conductive by a second scanning line, for controlling current from a power supply line to the driving transistor, a second switching transistor, switched between being conductive and non-conductive by a third scanning line, for controlling current transmitted from the driving transistor to the light emitting element, a first capacitance for holding a sampled signal voltage and a threshold voltage of the driving transistor across a gate electrode and a source electrode of the driving transistor, during a light emission period of the light emitting element, and a second capacitance arranged between the source terminal of the driving transistor and the power supply line, wherein, in a state where the first switching transistor is non-conductive and the second switching transistor is conductive, the sampling transistor is put in a conductive state to supply a reference voltage from a signal line and write a threshold voltage of the driving transistor to the first capacitance, and after that, in a state where the first and second switching transistors are non-conductive, the sampling transistor is put in a conductive state to write a signal voltage from the signal line to the first capacitance, and following that, the sampling transistor is put into a non-conductive state and the first and the second switching transistor are put into a conductive state to drive the driving transistor in accordance with a voltage written to the first capacitance and supply current to the light emitting element.

According to the present invention, it is possible to suppress variation in drive current with simple structural elements and with a small surface area for the structural elements.

DESCRIPTION OF THE PREFERRED EMBODIMENTS

Embodiments of the present invention will be described in the following based on the drawings.

Figure 1:
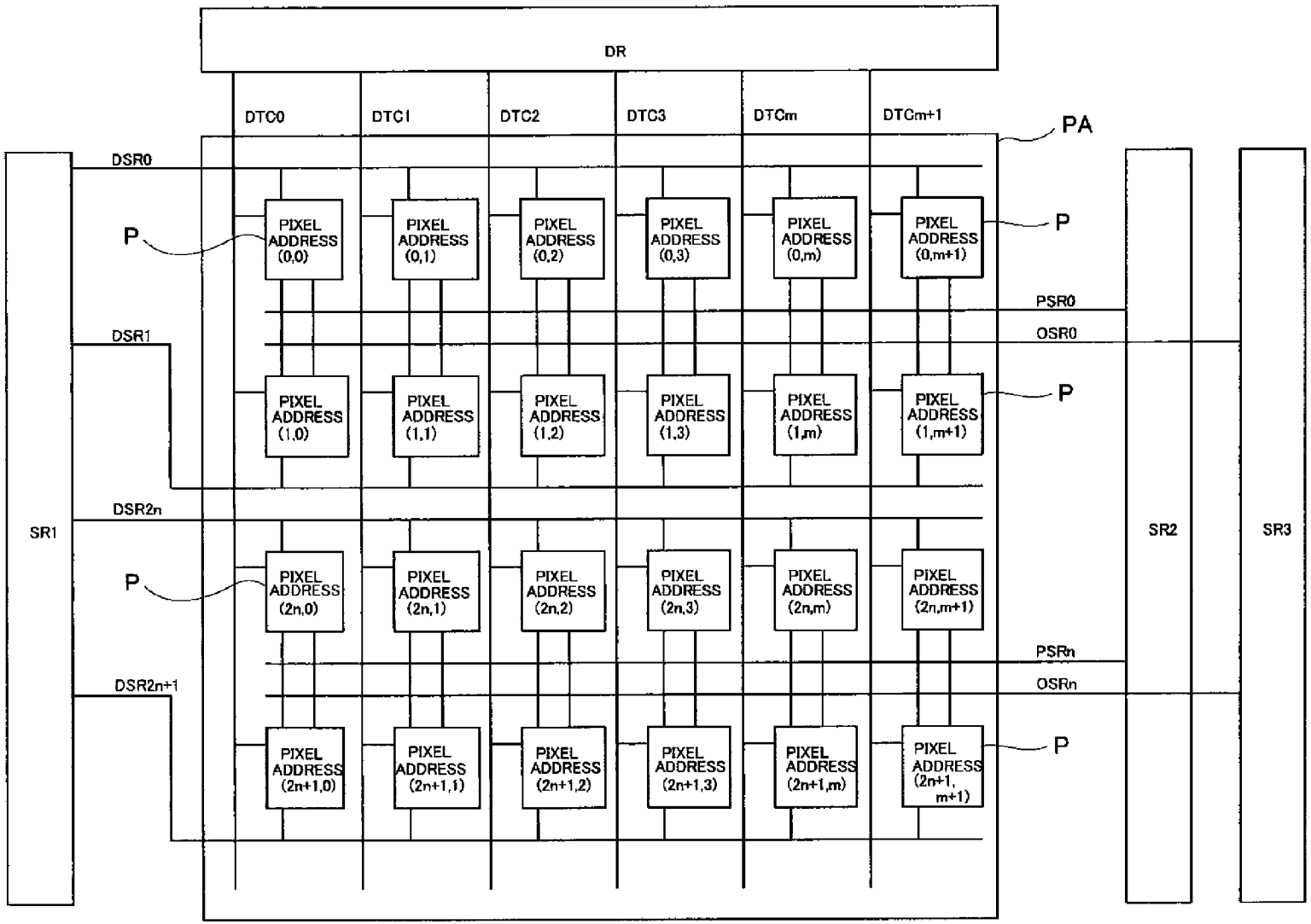
FIG. 1 is a structural diagram of a display device of this embodiment.

An overall structural drawing of a display device of this embodiment is shown in FIG. 1. As shown in FIG. 1, the display device of this embodiment has signal lines DTC (DCT0–DTCm+1) arranged in a column direction for each column of pixels P. Also, first scanning lines DSR (DSR0–DSRn+1) corresponding to each row of pixels P, and second scanning lines PSR (PSR0–PSRn) and third scanning lines OSR (OSR0 to USRn) each corresponding to two rows of pixels P, are arranged in the row direction. As shown in the drawing, the first scanning lines DSR are arranged alternately above and below each row of pixels P, which shows that apart from at the upper end and the lower end there are two first scanning lines DSR between every other row of pixels, while the second scanning lines PSR and the third scanning lines OSR are arranged between rows of pixels P where there is no first scanning line arranged.

Also, a signal line drive circuit DR for controlling the signal lines DTC, a first scanning line drive circuit SR1 for controlling the first signal lines, a second scanning line drive circuit SR2 for controlling the second scanning lines in the row direction, and a third scanning line drive circuit SR3 for controlling the third scanning lines in the row direction, are arranged at the periphery of the display section PA. In the drawing, the signal line drive circuit DR is arranged above the display section PA, the first scanning line drive circuit SR1 is arranged to the left of the display section PA, and the second scanning line drive circuit SR2 and the third scanning line drive circuit SR2 are arranged to the right of the display area PA.

Pixels P are arranged in a matrix in the display section PA, and addresses of the pixels are (0,0) to (2n+1, m+1).

Figure 2:
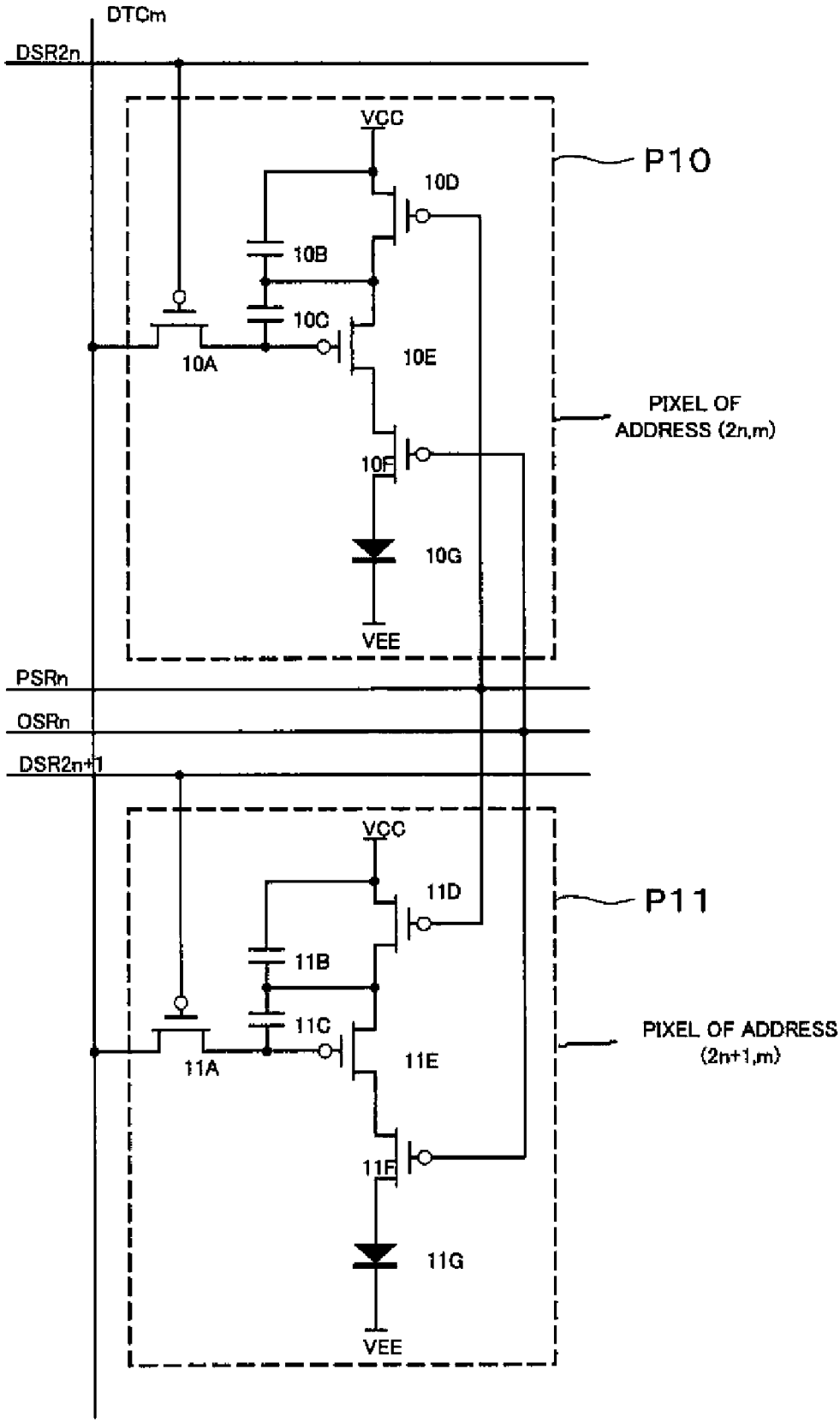
FIG. 2 is a drawing showing the structure of a pixel circuit.

The actual structure of a pixel circuit for the pixels P contained in the display device shown in FIG. 1 is shown in FIG. 2. Since the second scanning lines SR2 and the third scanning lines SR3 are each shared by two rows, they denote two pixels (pixel P10, P11) having pixel addresses (2n, m) and (2n+1, m).

As shown in FIG. 2, this pixel circuit is made up of a light emitting element (OLED) 10G that emits light as a result of current flow, such as an OLED, a sampling transistor 10A, a driving transistor 10E, first and second switching transistors 10D, 10F, a first capacitance 10C across a gate terminal and a source terminal of the driving transistor 10E, and a second capacitance 10B across the source terminal of the driving transistor 10E and a power supply VCC. With this example, p-type transistors have been adopted for all of the transistors, but it is also possible to adopt n-type transistors, and in this case it is preferable to have the light emitting element 10G connected to the drain side of the driving transistor 10E.

The drain or source of the sampling transistor 10A is connected to the signal line DTC, and then the source or drain is connected to the gate of the driving transistor 10E. Also, the gate of the sampling transistor 10A is connected to the first scanning line DSR.

The source of the first switching transistor 10D is connected to the power supply VCC. This power supply VCC is arranged on each row and each column as a power supply line, and is preferably connected to the source of the first switching transistor 10D of each pixel P. The gate of the first switching transistor 10D is connected to the second scanning line PSR, and the drain is connected to the source of the driving transistor 10E. Accordingly, the second capacitance 10B is arranged across the drain and source of the first switching capacitor 10D.

The drain of the driving transistor 10E is connected to the source of the second switching transistor 10F, with the drain of the second switching transistor 10F being connected to the anode of the light emitting element 10G, and the gate of the second switching transistor 10F is connected to the third scanning line OSR. Accordingly, the conductive or non-conductive state of the sampling transistor 10A is controlled by the first scanning line DSR, that of the first switching transistor 10D by the second scanning line PSR, and that of the second switching transistor 10F by the third scanning line OSR. The cathode of the light emitting element 10G is connected to a low voltage power supply (cathode) VEE.

Each of the elements of the lower pixel P11 in the drawing having pixel address (2n+1, m) is assigned reference numeral 11A-11G.

Figure 3:
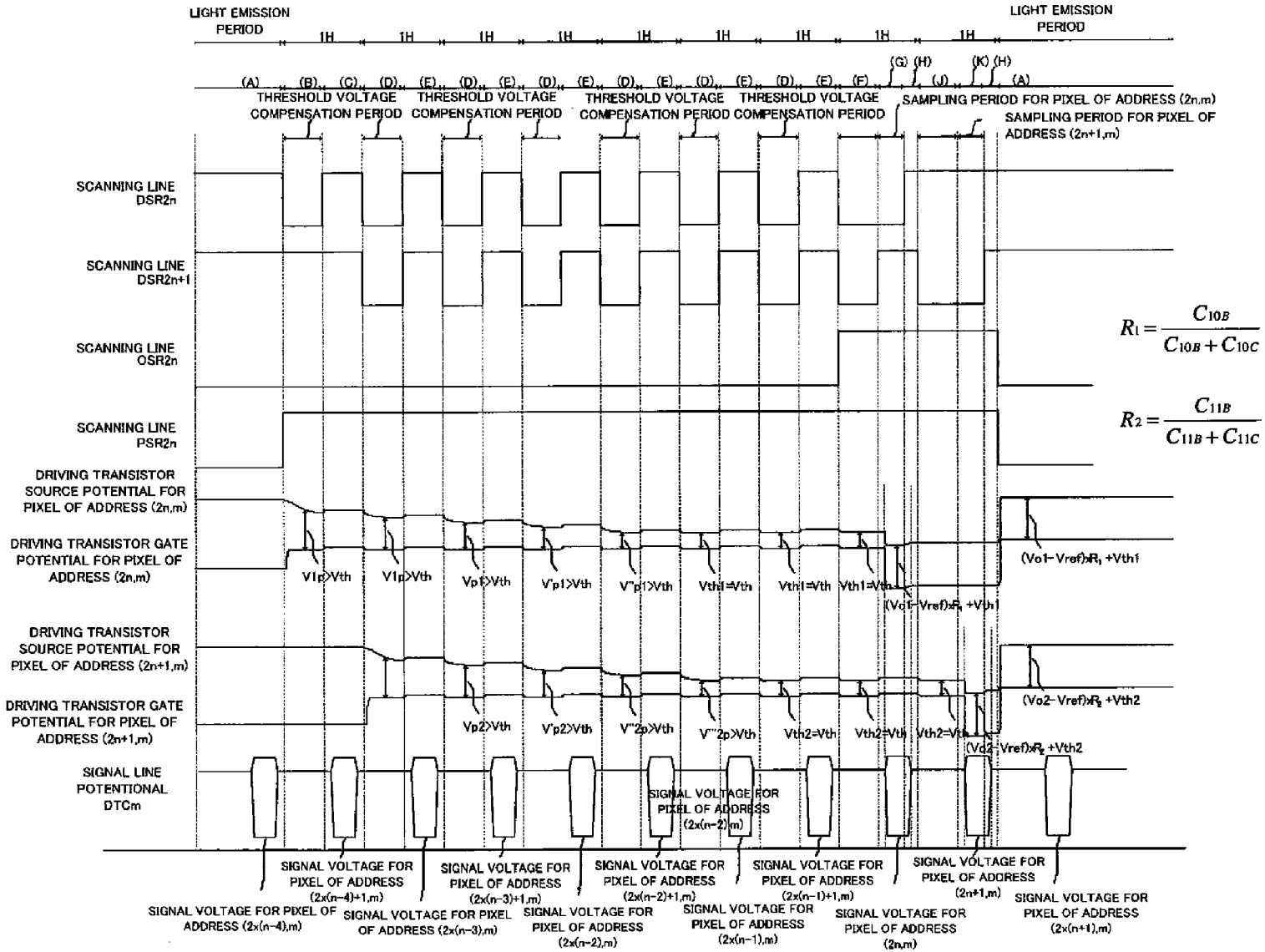
FIG. 3 is a drawing showing waveforms for each signal of this embodiment.
Figure 4A:
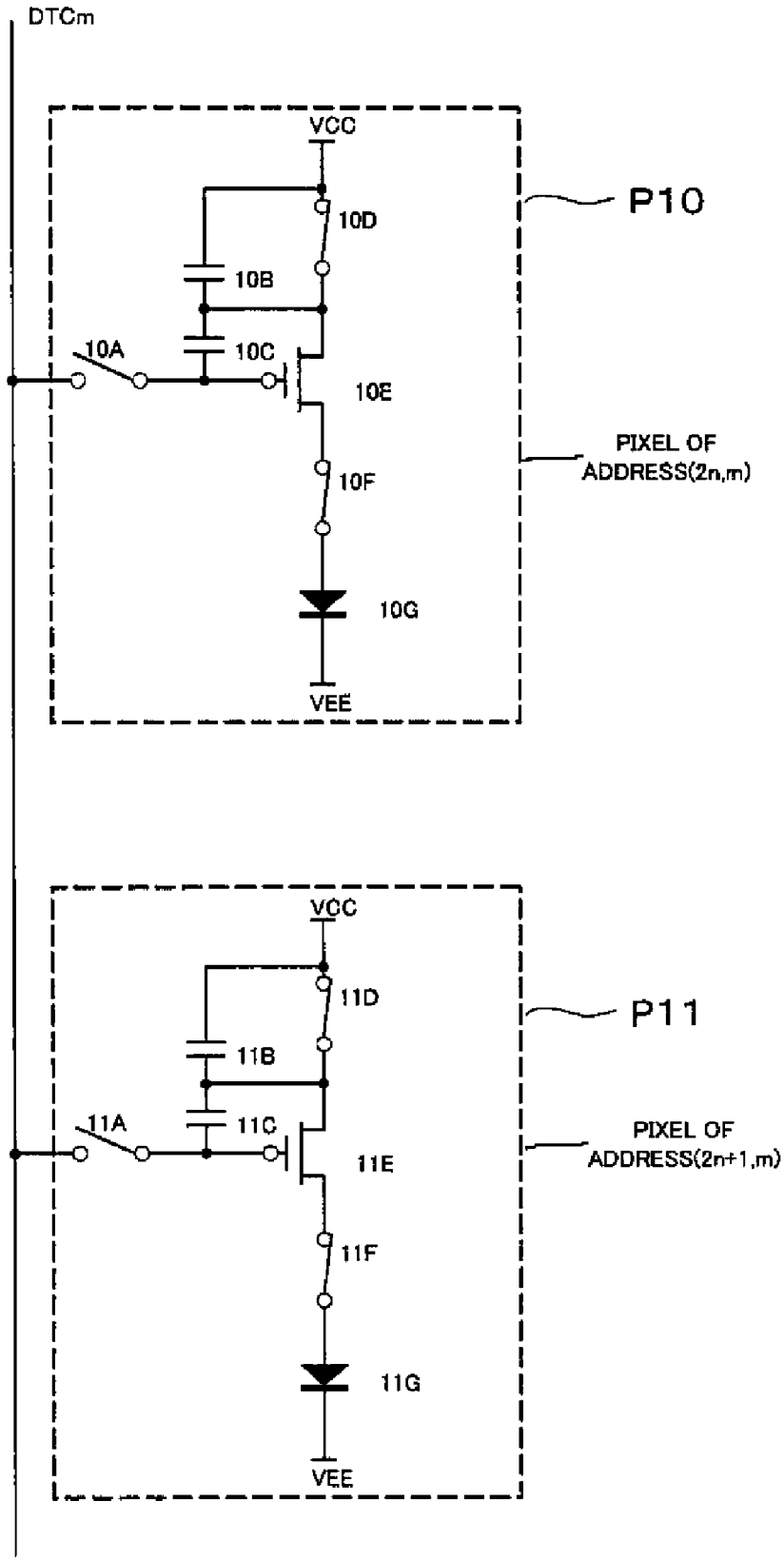
FIG. 4A is an explanatory drawing for operation of this embodiment.
Figure 4B:
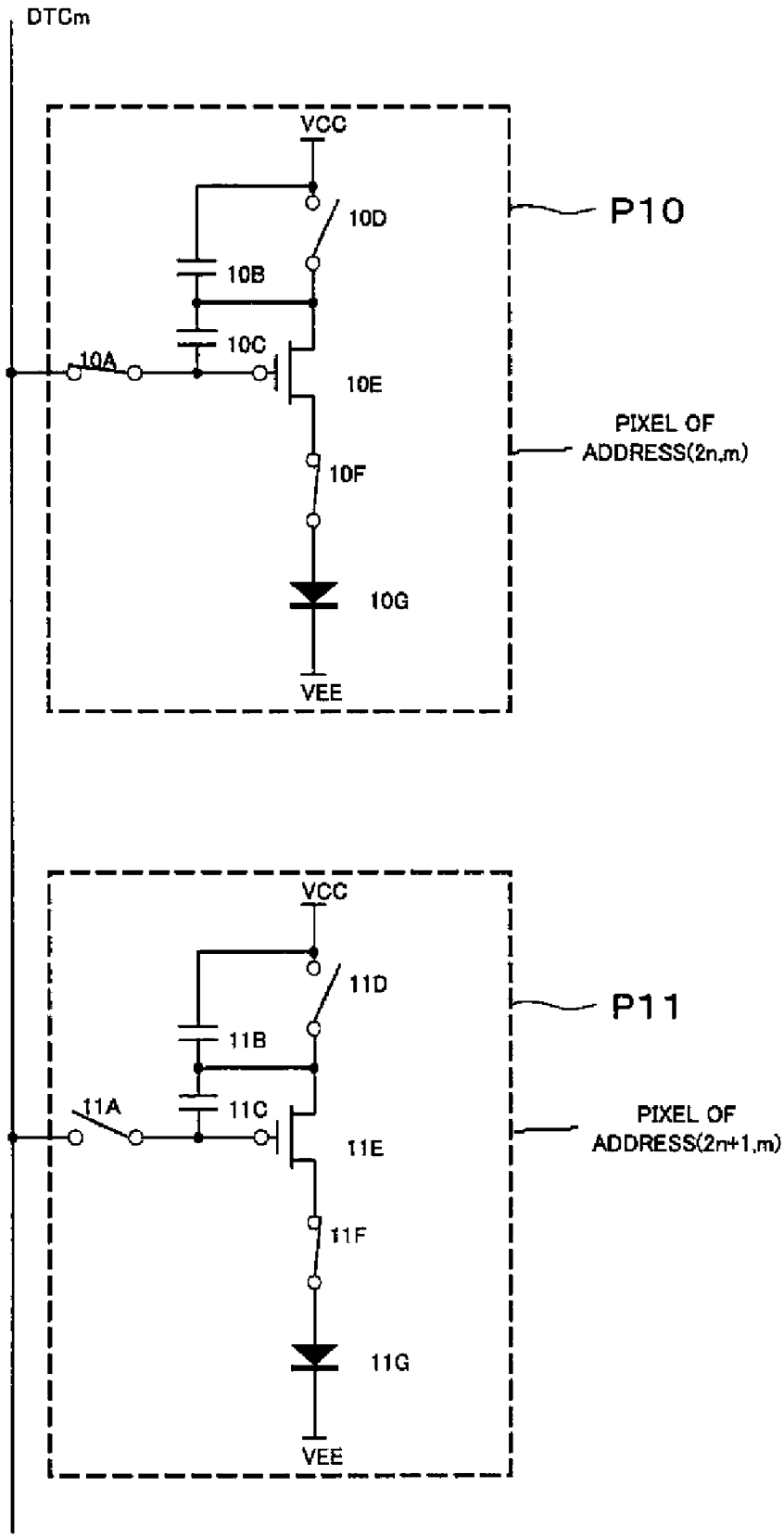
FIG. 4B is an explanatory drawing for operation of this embodiment.
Figure 4C:
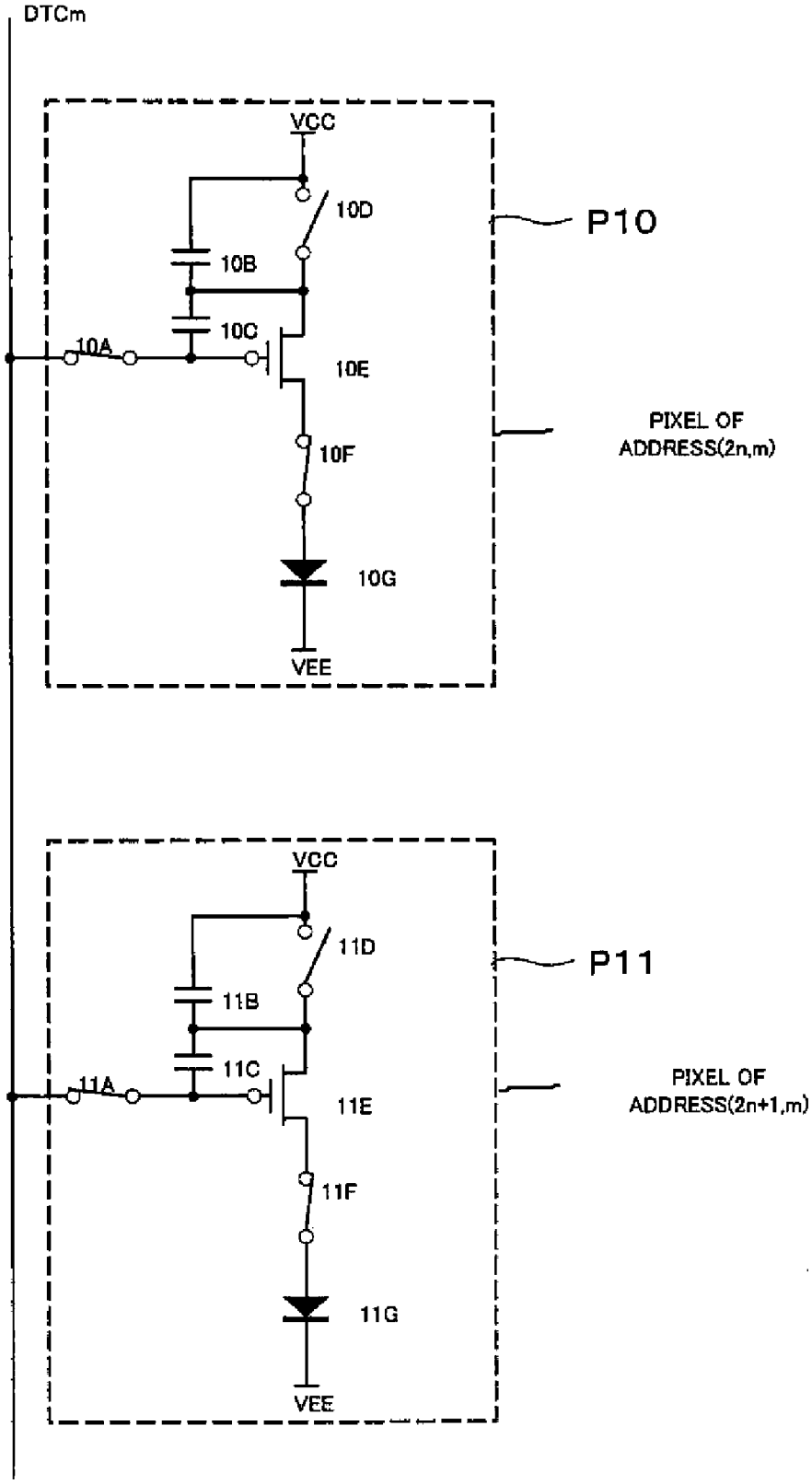
FIG. 4C is an explanatory drawing for operation of this embodiment.
Figure 4D:
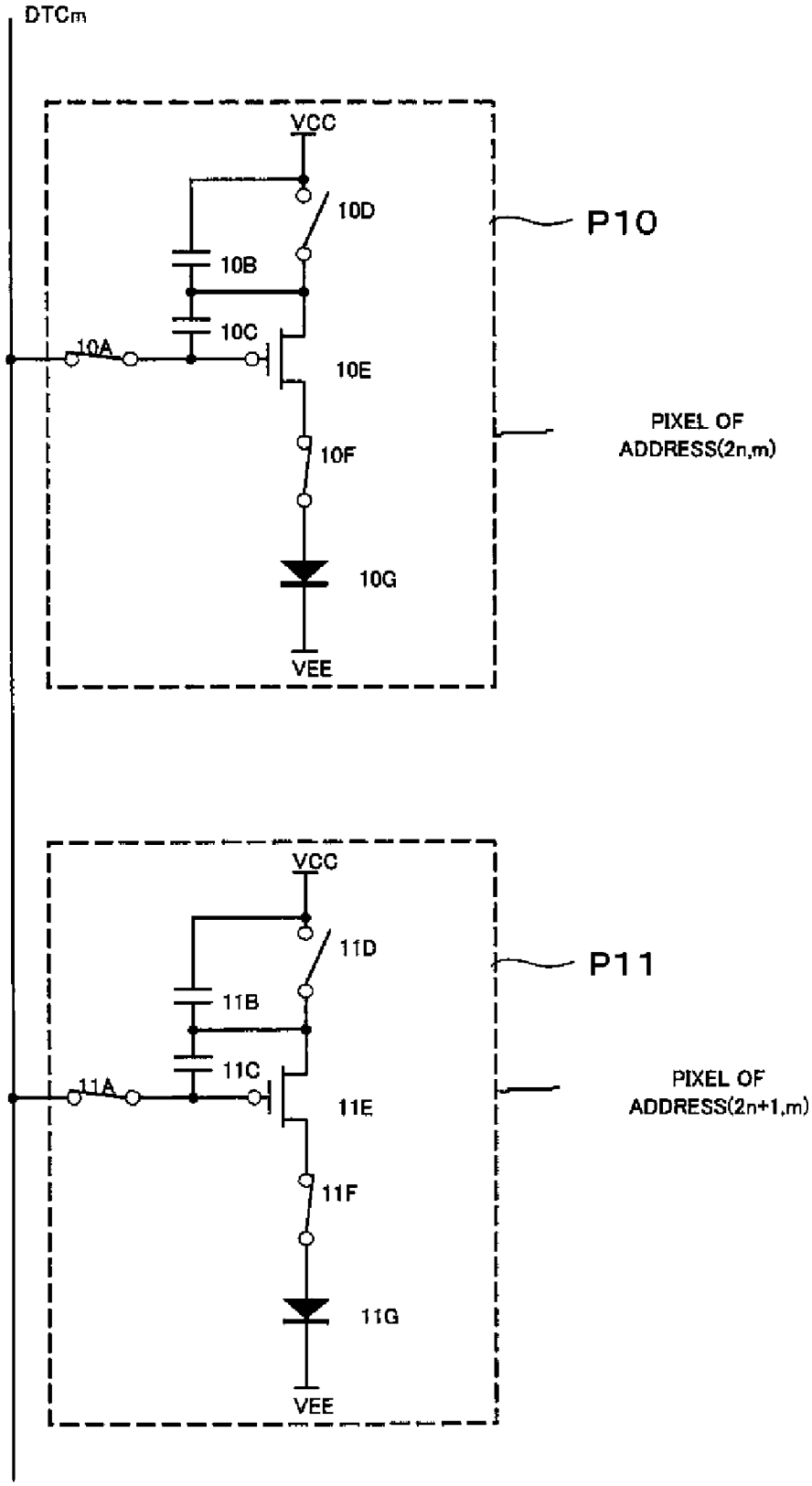
FIG. 4D is an explanatory drawing for operation of this embodiment.
Figure 4E:
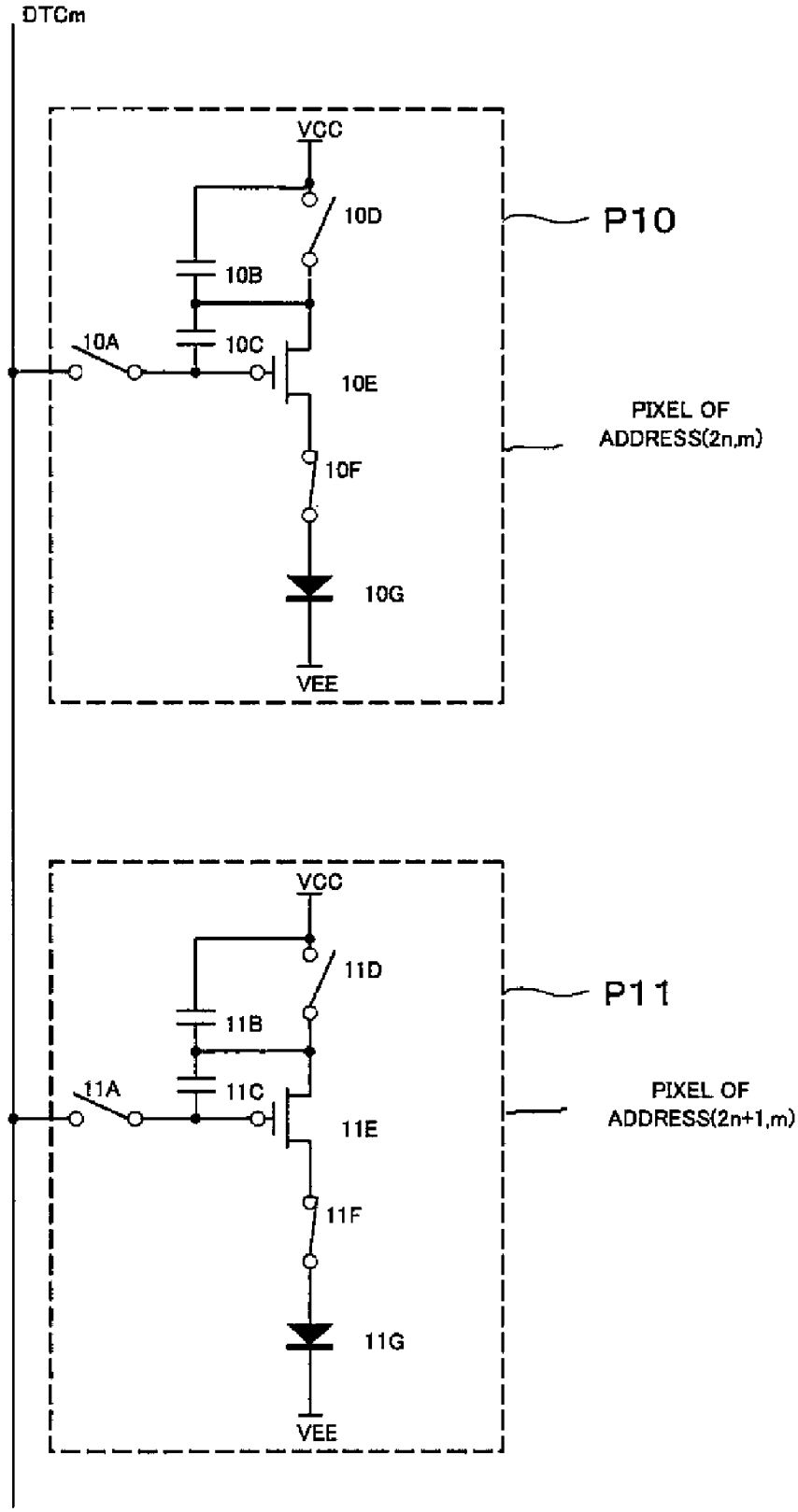
FIG. 4E is an explanatory drawing for operation of this embodiment.
Figure 4F:
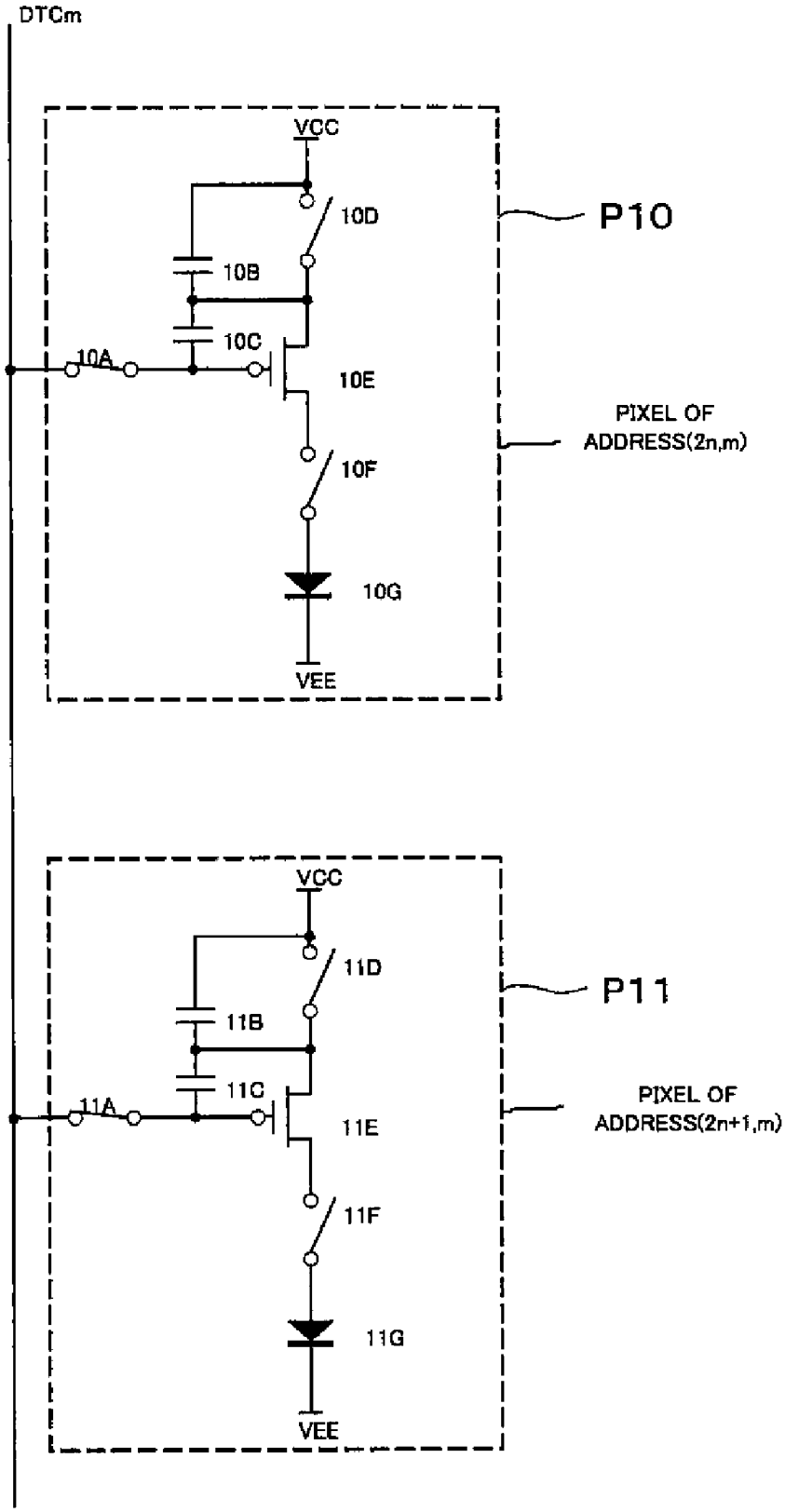
FIG. 4F is an explanatory drawing for operation of this embodiment.
Figure 4G:
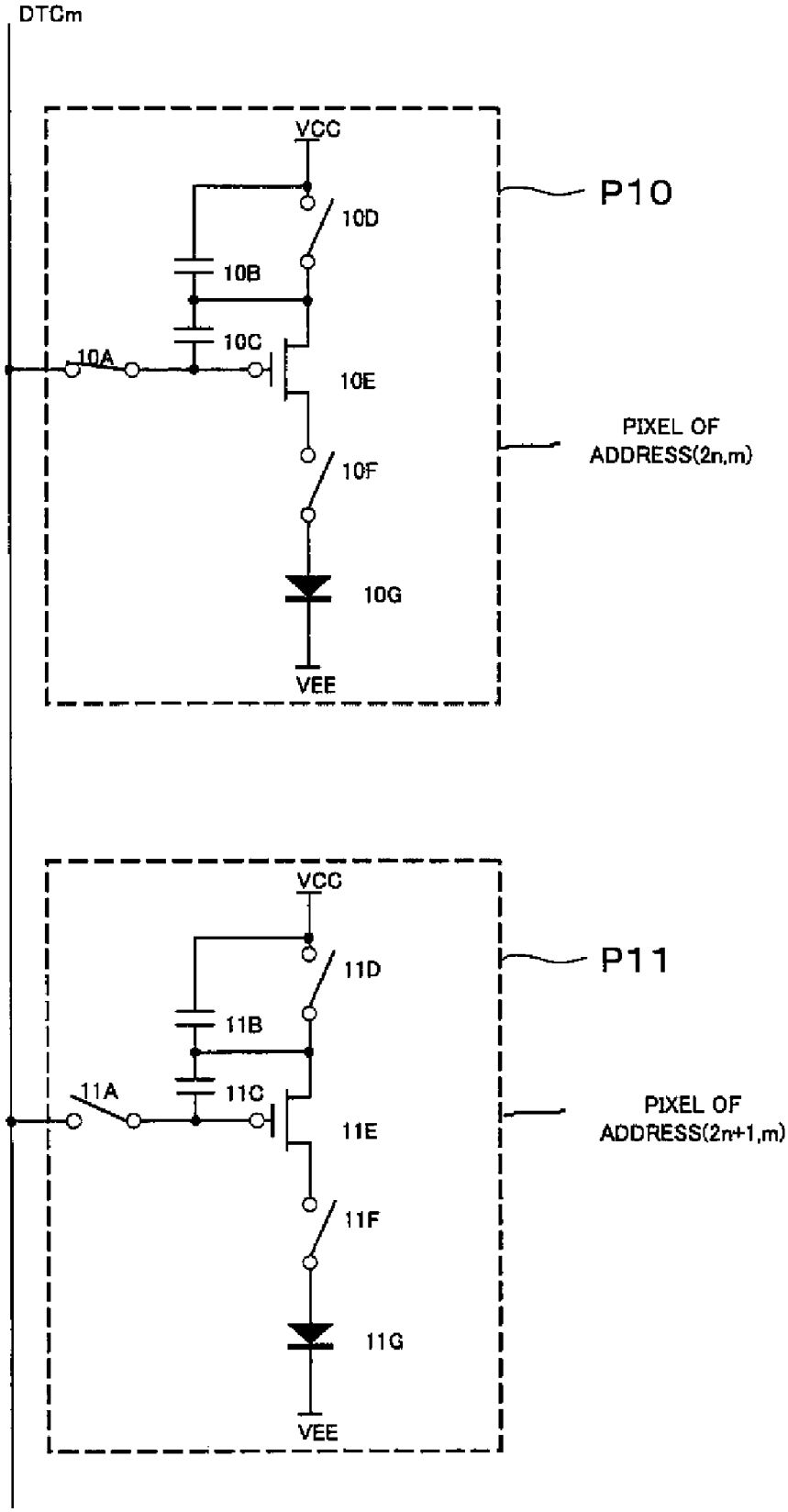
FIG. 4G is an explanatory drawing for operation of this embodiment.
Figure 4H:
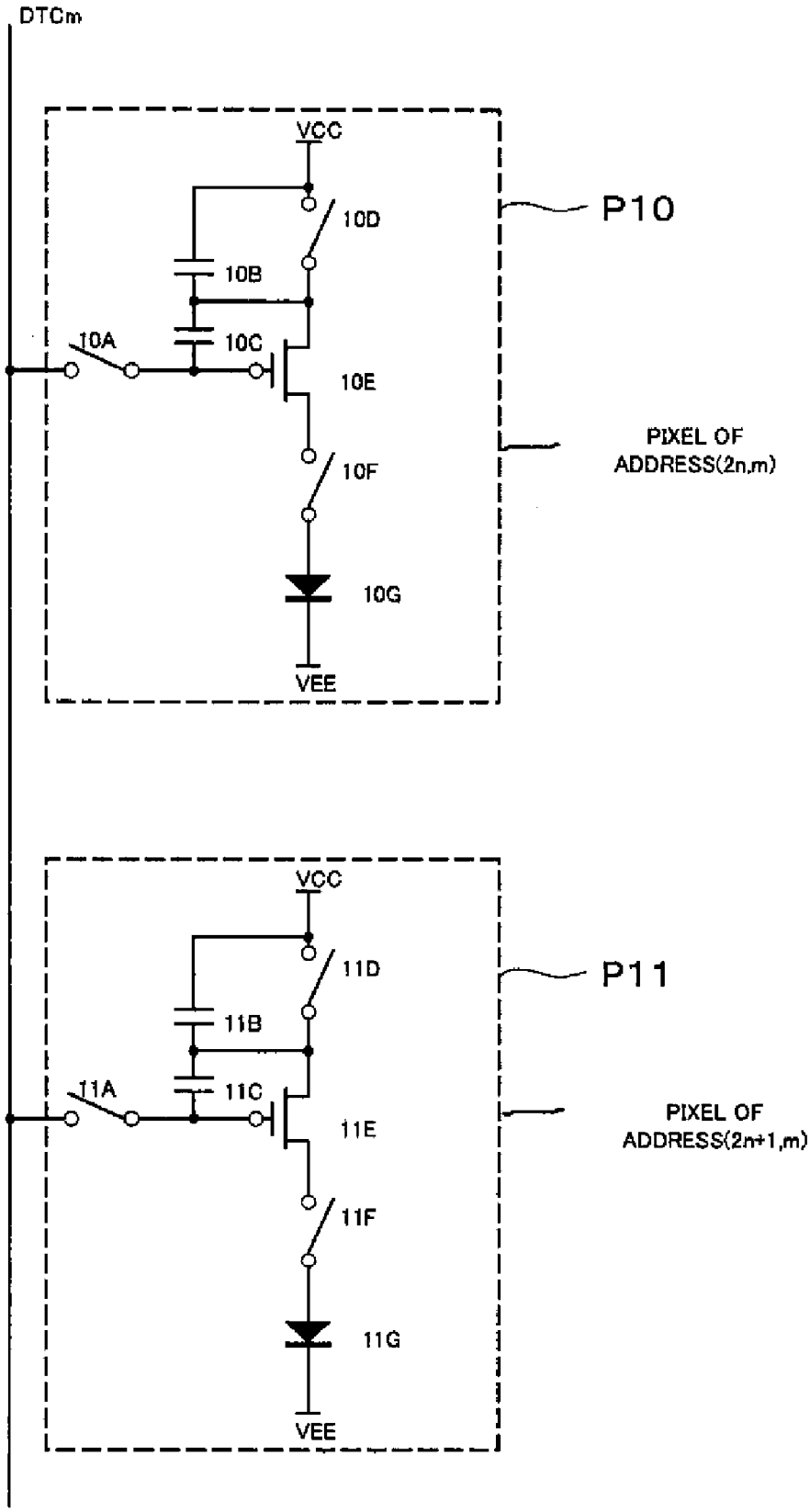
FIG. 4H is an explanatory drawing for operation of this embodiment.
Figure 4J:
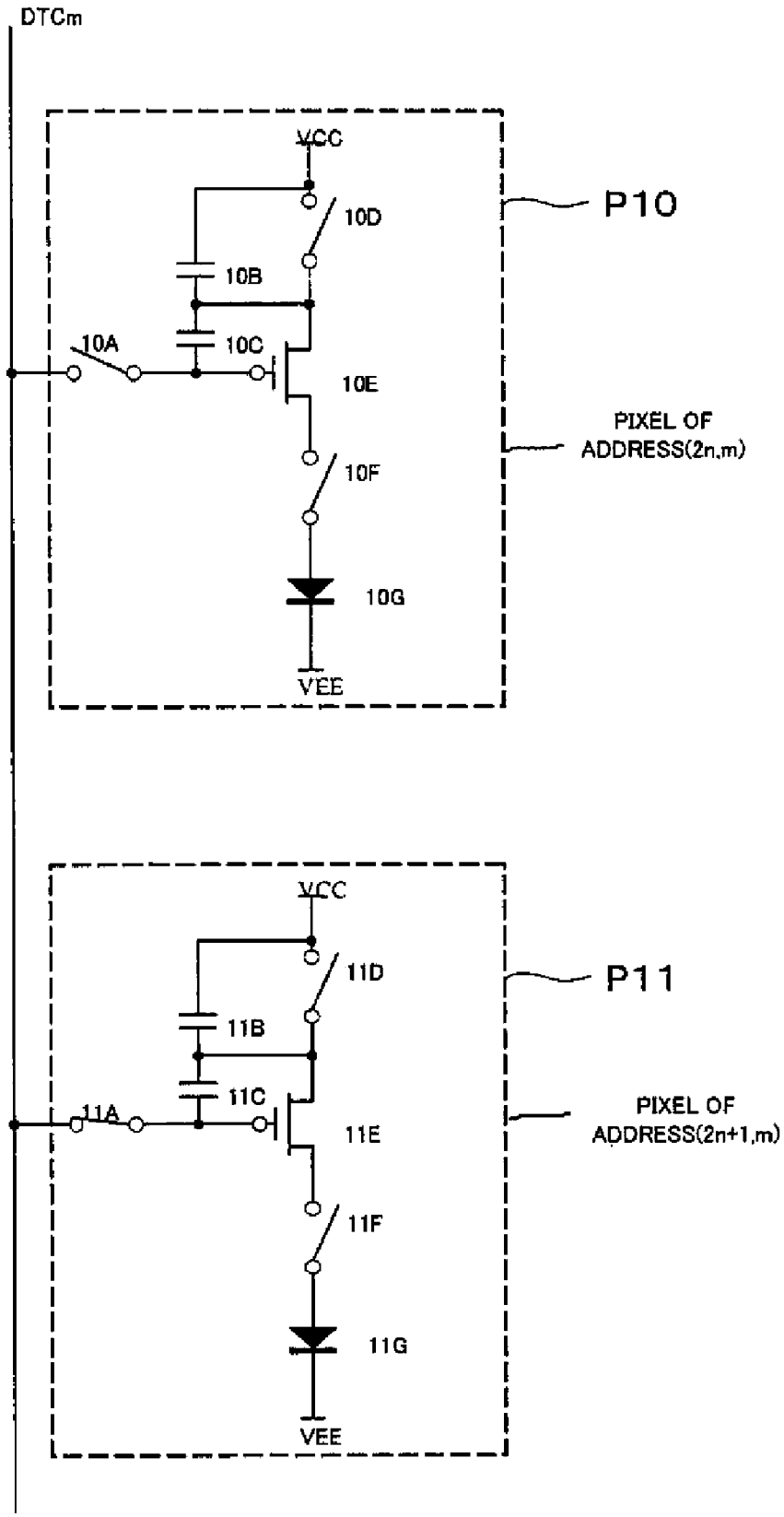
FIG. 4J is an explanatory drawing for operation of this embodiment.
Figure 4K:
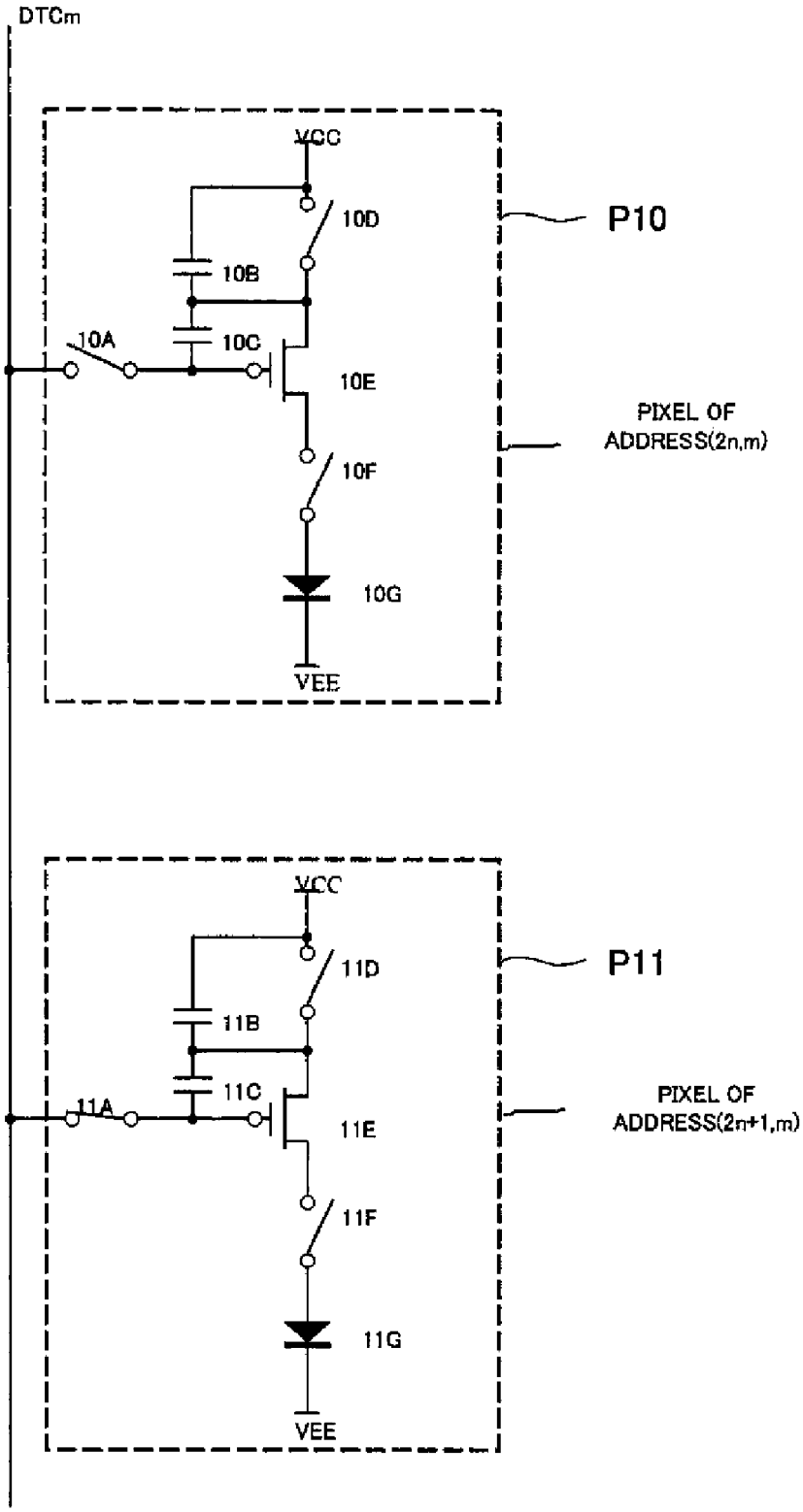
FIG. 4K is an explanatory drawing for operation of this embodiment.

FIG. 3 is a timing chart for potential for each scanning line and at each point of the pixel circuit, and an operating state of the pixel circuit at each point in time is shown in FIG. 4A to FIG. 4K.

In the following, display operation for this embodiment will be described using FIG. 3 and FIG. 4A to FIG. 4K. In the drawings, description is given for two pixels P, being pixel P10 of row 2n column m, and pixel P11 of row 2n+1 column m.

(A) FIG. 4-A: this period is a light emitting period. The sampling transistors 10A and 11A are in a non-conducting state, while the first and second switching transistors 10D, 11D, 10F and 11F are in a conducting state, current flows in the driving transistors 10E and 11E due to the voltage charged in the first capacitances 10C and 11C, and the light emitting elements 10G 11G emit light as a result of this current. This state is maintained until the next signal voltage is written to the first capacitors 10C, 11C, that is, for about one frame period.

(B) FIG. 4-B: This period is a threshold detection period for the driving transistor 10E of the pixel P10. The sampling transistor 10A is made conductive and the sampling transistor 11A is kept non-conductive. Also, the first switching transistors 10D, 11D are made non-conductive, and the second switching transistors 10F, 11F are kept in the conductive state. In this state, by making the signal line DTCm, of the m row a reference potential Vref, the gate terminal of the driving transistor 10E becomes Vref. Since the first switching transistors 10D and 11D are non-conductive, supply of current to the driving transistors 10E, 11E is interrupted. In the light emitting period, a voltage derived by adding the signal voltage to the threshold voltage was charged into the first capacitances 10C and 11C. However, in this threshold value detection period the driving transistor 10E is in a state where the current is 0, and voltage Vgs across the gate and source of the driving transistor 10E approaches the threshold voltage of the driving transistor 10E. Accordingly, the charged voltage of the first capacitance 10C approaches the threshold voltage of the driving transistor 10E.

On the other hand, in this period the sampling transistor 11A is made non-conductive, and so the reference voltage Vref of the signal line DTC is not supplied to the gate terminal of the driving transistor 11E, and a potential corresponding to the signal voltage remains on the gate terminal of the driving transistor 11E.

(C) FIG. 4-C: This period is a sampling period for another column, in this case the $2x(n-4)^{th}$ column. It is therefore necessary to ensure that there is no impact on pixels P10 and P11 of columns other than this. The sampling transistors 10A and 11A of the 2n column and the 2n+1 column are therefore made non-conductive.

(D) FIG. 4-D: This period is a threshold detection period for pixels P10 and P11. The signal line DTCm is made the reference potential Vref, and the gate terminals of the driving transistors 10E and 11E are made Vref, and so the sampling transistors 10A and 11A are made conductive. Since the supply of current to the driving transistors 10E and 11E is cut off, the switching transistors 10D and 11D between the source terminals of the driving transistors and the power supply are made non-conductive. In this way, the threshold voltages of the respective driving transistors 10E and 11E are written to the first capacitances 10C and 11C in both the pixels P10 and P11.

(E) FIG. 4-E: This period is a sampling period for the signal voltage of a pixel of another column. In FIG. 3, the E step is shown six times, but these are respectively the sampling periods for the $2x(n-3)^{th}$ column, the $2x(n-3)+1^{th}$ column, the $2x(n-2)^{th}$ column, the $2x(n-2)+1^{th}$ column, the $2x(n-1)^{th}$ column and the $2x(n-1)+1^{th}$ column. It is therefore necessary to ensure that there is no impact on pixels P of columns other than these. Accordingly, the sampling transistors 10A and 11A of pixels P10 and P11 of the 2n column and the 2n+1 column are non-conductive. Therefore, for each electrode of these pixels, potentials at the time of the threshold value detecting period of FIG. 4-E are held.

The steps of FIG. 4-D and FIG. 4-E are repeated until the gate voltage of the driving transistor 10E becomes the threshold voltage. In FIG. 3, they are repeated six times. At this time, the source electrode of the driving transistor 10E becomes Vs1=Vref−Vth1, and the source electrode of the driving transistor 11E becomes VS2=Vref−Vth2. Threshold voltages Vth1 and Vth2 of the respective driving transistors 10E and 11E are therefore charged to the first capacitances 10C, 11C. This charging is gradually carried out through repetition. The first switching transistors 10D and 11D are turned off so that no current flows in the driving transistors 10E and 11E, and the voltages of the source electrodes of the driving transistors 10E, 11E are set to Vs1=Vref−Vth1 and Vs2=Vref−Vth2, and so although it takes time it is possible to charge the first capacitances 10C and 11C to the threshold voltage Vth1 and Vth2 of the respective driving transistors 10E and 11E.

(F) FIG. 4-F: this period is a sampling preparation period. The first and second switching transistors 10D, 11D, 10F and 11F are made non-conductive, and the sampling transistors 10A, 11A are put in the conductive state. Also, a reference voltage is supplied to the signal line DTCm.

(G) FIG. 4-G: This period is a sampling period for the signal voltage Vo1 for pixel P10. The signal line DTCm is made the signal voltage Vo1 for pixel P10, and sampling of the signal voltage Vo1 is carried out with the sampling transistor 10A in a conductive state (signal voltage Vo1 is written to the first capacitance 10C). The gate electrode potential of the driving transistor 10E changes from Vref to Vo1.

At this time, the source electrode of the driving transistor 10E becomes $$Vs1 = Vref - Vth1 + (Vo1 - Vref) \times C_{10C} / (C_{10B} + C_{10C}),$$

and $$\begin{aligned} Vgs1 &= Vo1 - (Vref - Vth1 + (Vo1 - Vref) \times C_{10C} / C_{10B} + C_{10C}) \\ &= (Vo1 - Vref) \times C_{10B} / (C_{10B} + C_{10C}) + Vth \end{aligned}$$

Here, $C_{10B}$ and $C_{10C}$ represent capacitance values of the first and second capacitances 10B and 10C.

The sampling transistor 11A is non-conductive, and the previous state is maintained.

(H) FIG. 4-H: Since the sampling transistors 10A and 11A are non-conductive, the potential of the previous operation is held at each electrode.

(J) FIG. 4-J: This period is a sampling preparation period, with the sampling transistor 10A, and the first and second switching transistors 10D, 11D, 10F and 11F being non-conductive.

(K) FIG. 4-K: This period is a sampling period for the signal voltage Vo2 for pixel P11. Signal line DTCm is made the signal voltage of pixel P11, and signal voltage Vo2 is sampled by the sampling transistor 11A. The gate electrode potential of the driving transistor 11E changes from Vref to Vo2.

At this time, the source electrode of the driving transistor 11E becomes $$Vs2 = Vref - Vth2 + (Vo2 - Vref) \times C_{11C} / (C_{11B} + C_{11C})$$

and $$VGS2 = Vo2 - (Vref - Vth + (Vo2 - Vref) \times C_{11C} / (C_{11B} + C_{11C})$$
$$= (V02 - Vref) \times C_{11B} / (C_{11B} + C_{11C}) + Vth2$$

A characteristic formula for Ids of driving transistors 10A and 11E is expressed by $Ids=\beta/2(Vgs-Vth)^2$.

For pixels P10 and P11, if Vgs1 and Vgs2 are respectively input, the drain currents of the respective driving transistors 1-A and 11E become $$Ids1=\beta/2((Vo1-Vref)\times C10B/(C10B+C10C))^2$$

$$Ids2=\beta/2((Vo2-Vref)\times C11B/(C11B+C11C))^2$$

the term Vth is compensated, and it is possible to suppress variations in drive current.

Also, since the capacitance value of the second capacitance 10B is made small compared to the first capacitance 10C, it is possible to make the effect of the first and second capacitances on the signal voltage small. It is also possible to alter the signal voltage taking into consideration the effects of these capacitances.

In this way, according to this embodiment the threshold voltages of driving transistors 10E and 11E are written to the first capacitances 10C and 11C in a horizontal period in a state where no current is flowing in the light emitting elements 10G and 11G, which shows that it is possible to detect threshold voltage comparatively accurately. Also, when writing the signal voltage to the first capacitance, the driving transistors 10E and 11E have their connections of the source terminals and drain terminals to the power supply lines and light emitting element 10G cut off, and so it is possible to write the signal voltage without losing charge of the first capacitance 10C.

Since the first scanning lines DSR are arranged two for every two rows of pixels, and the second and third scanning lines PSR, OSR are collected together in pairs and arranged one for every two rows of pixels, two scanning lines are arranged in the row direction for every row, and it is possible to simplify the structure overall.

Also, the first scanning lines are sequentially driven one at a time every one horizontal period, but the second scanning lines and the third scanning lines are sequentially driven every two horizontal periods. Therefore, compared to the drive frequency of the first scanning lines, the drive frequency of the second and third scanning lines is ½.

The invention has been described in detail with particular reference to certain preferred embodiments thereof, but it will be understood that variations and modifications can be effected within the spirit and scope of the invention.

PARTS LIST

10A sampling transistor
10B second capacitance
10C first capacitance
10D first switching transistor
10E driving transistor
10F second switching transistor
10G light emitting element (OLED)
11A sampling transistor
11C first capacitance
11D switching transistor
11E driving transistor
11F switching transistor
11G light emitting elements
DR drive circuit
DSR first scanning lines
DTC signal line
OSR third scanning lines
P pixels
P10 pixel
P11 lower pixel
PA display section
PSR second scanning lines
SR1 first scanning line drive circuit
SR2 second scanning line drive circuit
SR3 third scanning line
VCC power supply
VEE low voltage power supply (cathode)

The invention claimed is:

1. An active matrix electroluminescent display, comprising:

(a) a matrix of pixels having a column direction and a row direction;

(b) a plurality of first scanning lines arranged in the row direction, each corresponding to a respective row of pixels, and a first scanning line drive circuit for controlling the first scanning lines;

(c) a plurality of second scanning lines arranged in the row direction, each corresponding to two rows of pixels, and a second scanning line driving circuit for controlling the second scanning lines;

(d) a plurality of third scanning lines arranged in the row direction each corresponding to two rows of pixels, and a third scanning line driving circuit for controlling the third scanning lines;

(e) a plurality of signal lines arranged in the column direction and a signal line drive circuit for controlling the signal lines;

(f) a plurality of power supply lines;

(g) each pixel including:

(i) an electroluminescent element for emitting light as a result of current flow;

(ii) a sampling transistor, switched between being conductive and non-conductive by the corresponding first scanning line, for sampling a signal voltage that determines a light emitting level of the light emitting element from the corresponding first scanning line, (iii) a driving transistor for supplying a current corresponding to the voltage sampled by the sampling transistor to the light emitting element, wherein the driving transistor has a threshold voltage, (iv) a first switching transistor, switched between being conductive and non-conductive by the corresponding second scanning line, for controlling current from the corresponding power supply line to the driving transistor, (v) a second switching transistor, switched between being conductive and non-conductive by the corresponding third scanning line, for controlling current transmitted from the driving transistor to the light emitting element, (vi) a first capacitance for holding the sampled signal voltage and the threshold voltage of the driving transistor across a gate electrode and a source electrode of the driving transistor during a light emission period of the light emitting element; and (vii) a second capacitance arranged between the source terminal of the driving transistor and the power supply line; and (h) means for sequentially:

(i) selecting a scanning line and a pixel in the scanning line;

(ii) causing the first switching transistor of the selected pixel to be non-conductive, causing the second switching transistor of the selected pixel to be conductive, causing the sampling transistor of the selected pixel to be conductive, and supplying a reference voltage from the signal line, so that a threshold voltage of the driving transistor of the selected pixel is written to the first capacitance of the selected pixel;

(iii) causing the sampling transistor of the selected pixel to be non-conductive;

(iv) repeating steps ii) and iii) until the gate voltage of the driving transistor of the selected pixel becomes the threshold voltage of the driving transistor of the selected pixel;

(v) causing the first and second switching transistors of the selected pixel to be non-conductive and causing the sampling transistor of the selected pixel to be conductive so that a signal voltage from the signal line is written to the first capacitance of the selected pixel;

(iv) causing the sampling transistor of the selected pixel to be non-conductive and the first and the second switching transistors of the selected pixel to be conductive to drive the driving transistor of the selected pixel in accordance with the voltage written to the first capacitance of the selected pixel to supply current to the light emitting element, so that variations in the threshold voltages of the driving transistors of the pixels are compensated, wherein each second scanning line is commonly connected to gate electrodes of the first switching transistors and each third scanning line is commonly connected gate electrodes of the second switching transistors in each pair of pixels of the two rows of pixels that faces each other.

2. The active matrix electroluminescent display according to claim 1, wherein the first scan lines are sequentially driven one at a time every one horizontal period, and wherein the second and third scanning lines are sequentially driven every two horizontal periods.

* * * * *